United States Patent [19]

Vogele

[11] Patent Number: 5,005,289

[45] Date of Patent: Apr. 9, 1991

[54] DEVICE FOR THE CUTTING OF PLATES OF SOFT MATERIAL

[76] Inventor: Richard Vogele, Bernaustrasse 367, CH-4353 Leibstadt, Switzerland

[21] Appl. No.: 502,508

[22] Filed: Mar. 30, 1990

[30] Foreign Application Priority Data

Apr. 5, 1989 [CH] Switzerland ..... 01263/89

[51] Int. Cl.[5] ..... B26D 7/10

[52] U.S. Cl. ..... 30/140; 30/278; 83/171

[58] Field of Search ..... 83/171, 651.1, 455, 83/454, 453; 30/140, 278

[56] References Cited

U.S. PATENT DOCUMENTS

| | | | |
|---|---|---|---|
| 53,835 | 4/1866 | Kepner | 83/454 |
| 2,438,156 | 3/1948 | Dodge | 83/171 |
| 2,930,878 | 3/1960 | Camerini | 83/171 |
| 4,622,743 | 11/1986 | Voegele | 30/140 |

FOREIGN PATENT DOCUMENTS

| | | | |
|---|---|---|---|
| 3046643 | 7/1982 | Fed. Rep. of Germany | 83/171 |
| 3115402 | 12/1982 | Fed. Rep. of Germany | 83/171 |

*Primary Examiner*—Hien H. Phan
*Assistant Examiner*—John M. Husar
*Attorney, Agent, or Firm*—Lee, Mann, Smith, McWilliams & Sweeney

[57] ABSTRACT

A device for cutting plates of soft material, such as synthetic material foam plates or plates of glass wool. Synthetic material foam plates are cut with a heated cutting wire. The device consists of two separate parts A and B. Part A comprises a base plate (1) with lateral guides (2) for a press-on cutting rule (3). On the front of the guides (2) there are arranged electrically conducting guide strips (5), which are insulated from the guides (2). The guide strips are connected to a current source (not represented). Part B is a frame-saw type bow, between the arms (8) of which there is arranged the cutting wire (6). When the bow is pressed with its arms onto the guide strips (5), current flows through the wire (9) making it possible to cut. Soft plates of glass wool are cut with a knife (not represented), which is guided along the press-on cutting rule (3).

10 Claims, 2 Drawing Sheets

DEVICE FOR THE CUTTING OF PLATES OF SOFT MATERIAL

BACKGROUND OF THE INVENTION

The invention relates to a transportable device for the cutting of plates of soft material with the aid of a cutting member and a base plate with lateral guides, in which a press-on cutting rule is movable up and down guided parallel to the edge of the base plate. If the plate to be cut is a synthetic material foam plate, a cutting member comprising an electrically heated wire is used. If the plate is, for example, of glass wool, it can be cut with the aid of a knife guided along the press-on cutting rule.

Similar devices are known. They are used mostly in building construction. For this reason the device is constructed transportably and the energy for the heating of the cutting wire is drawn mostly from a battery. After cutting, it may be forgotten to turn off the current. This has the disadvantages of unnecessary discharging through the battery and the danger that someone will be burned on the hot wire. Through carelessness there can even arise a fire if an easily combustible object comes in contact with the hot wire.

The invention sets for itself solving the problem of obviating these disadvantages, such as arise in a cutting operation with a heated wire.

SUMMARY OF THE INVENTION

The invention solves this problem with a device which has the features named in the characterizing part of patent claim 1. The electrically conducting lay-on strips can remain constantly on voltage, without the battery being discharged in the process. The cutting wire is held in a separate bow, similar to a frame saw. Only for cutting are the downward-directed arms of the bow pressed on the lay-on strips, so that it is only then that current flows and it is possible to cut with the wire. After completion of the cut, the bow with the wire is laid on the side and no more current flows.

BRIEF DESCRIPTION OF THE DRAWINGS

In the appended drawing there is represented an example of an embodiment of the invention that attains the foregoing objectives, which is subsequently described.

DETAILED DESCRIPTION OF THE INVENTION

Figures 1A, 1B:
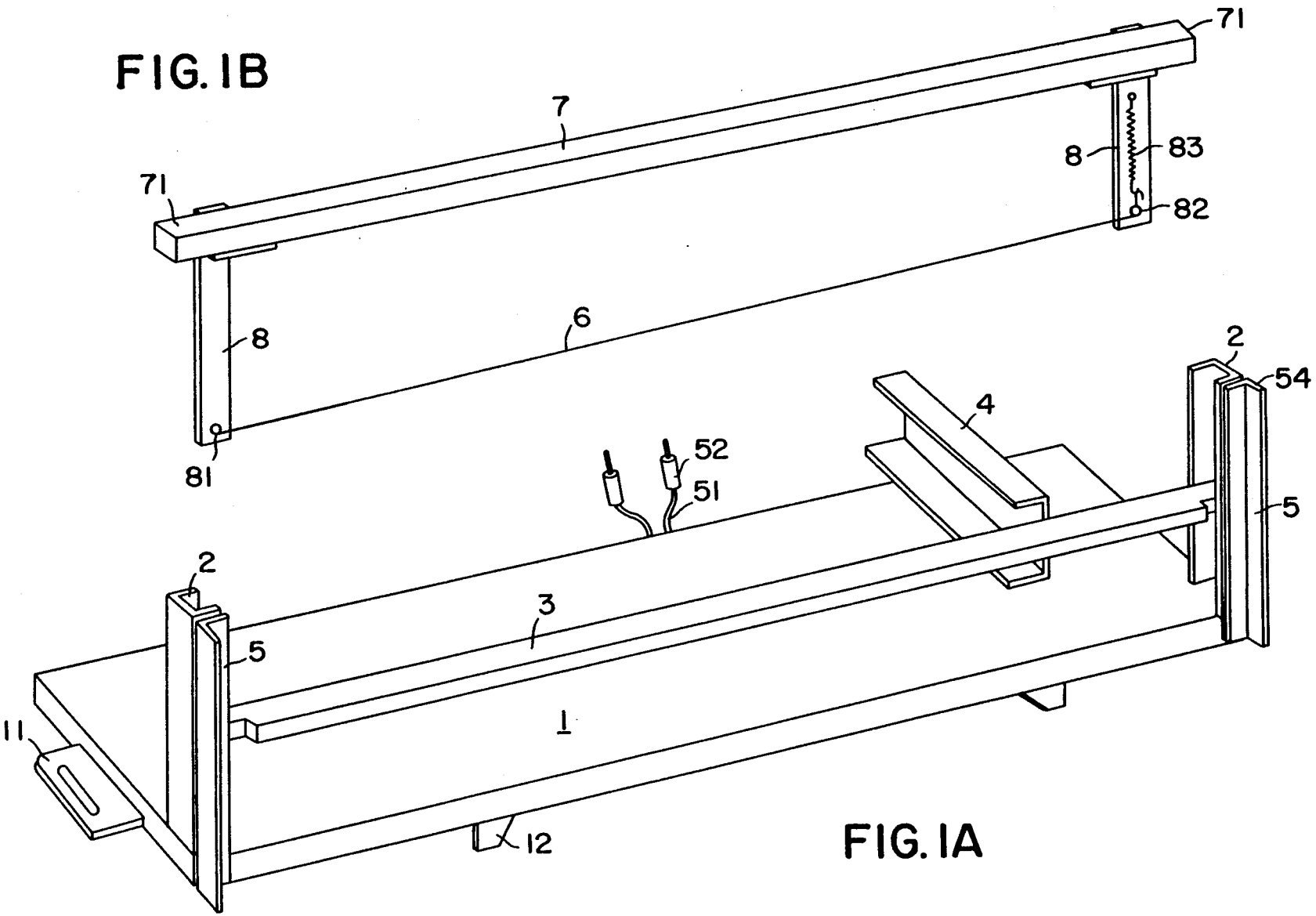
FIGS. 1A & 1B show the device in simplified representation.

FIGS. 1 & 1B show the device in perspective. It comprises a part A represented in the lower part of the drawing with a base plate 1 and a separate part B with a cutting wire 6 stretched in a bow in the manner of a frame saw.

Part A comprises the base plate 1, on the front edge of which there are arranged two U-shaped guide rails 2, which serve for the guidance of a press-on cutting rule 3. To the base plate there is fastenable a guide rail 4 for a plate to be cut.

In the front of each guide there are arranged L-shaped insulated lay-on strips 5, which are L-shaped in cross section. Connecting lines 51 led through the base plate are connected with the lay-on strips 5. On the outer ends there are arranged plugs 52 for the connection to the current source, such as, for example, an automobile battery. On the narrow side of the base plate there are arranged slider-type extractable suspension strips 11. The device can then be used standing horizontally or hanging on the wall.

Under the base plate 1 there are arranged stops 12, which are aligned upon the cut plane.

The cutting member B consists of a bow, on which the cutting wire 6 is held in a stretched position. The bow itself consists of a lengthwise bar 7 of electrically insulating material and on the ends of the bar there are arranged downward-directed arms 8, between which the cutting wire 6 is stretched.

The arms 8 consist of electrically conducting material. To the left arm 8 there is fastened at 81 the cutting wire 6. On the right arm 8 it is deflected over a lug 82 and held in a tensed state by means of a tension spring 83.

Figure 2:
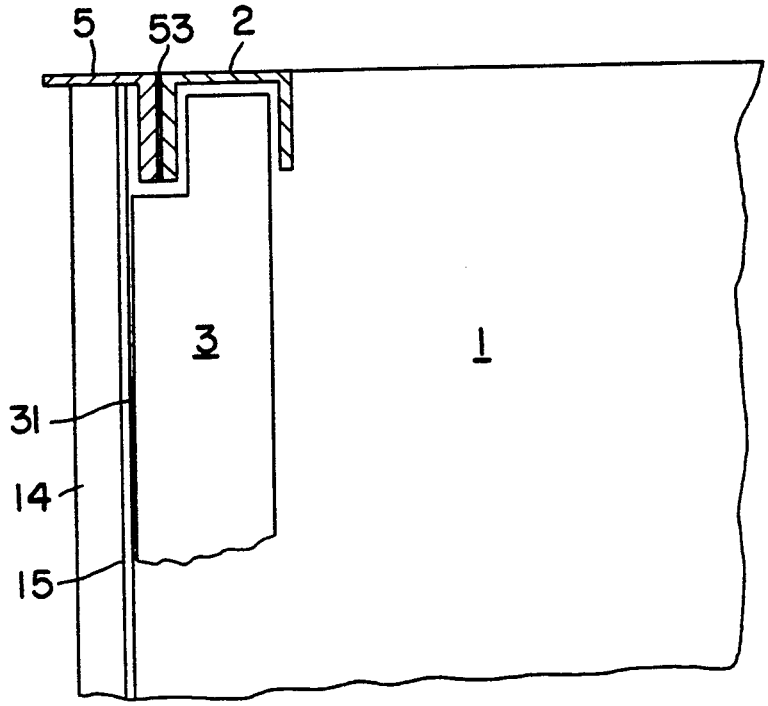
FIG. 2 shows a part of the device in a view from above on a larger scale.
Figure 3:
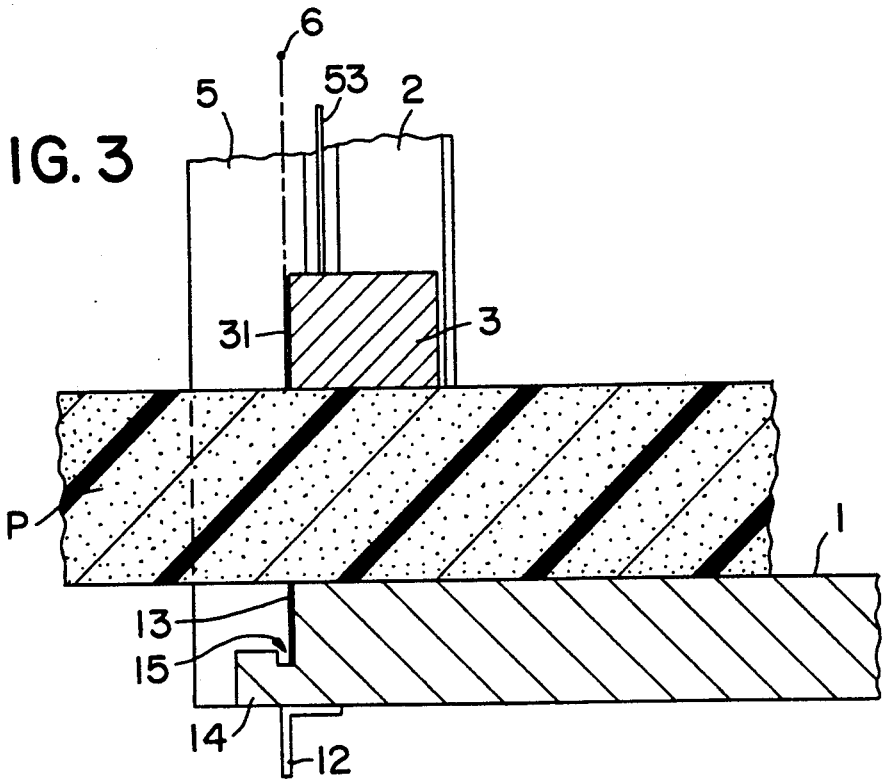
FIG. 3 shows a vertical section of the device on a larger scale.

FIGS. 2 and 3 show parts of the device on a larger scale, in which there are also to be seen further details. In these figures the insulation layer 53 is clearly recognizable between the guide rails 2 and the lay-on strips 5. The base plate 1, too, is provided on its front edge with an insulation layer 13, just as is the press-on cutting rule 3. The latter has on its front side an insulation layer 31. The reasons for these insulation layers 31, 13 is clear if one considers that the cutting wire 6 is guided during cutting along the dot-and-dashed line near the press-on cutting rule and the base plate.

The lengthwise bar 7 of the bow of the cutting member B extends at 71 a little beyond the arms 8. These projections 71 of the lengthwise bar form a stop on the upper ends of the lay-on strips of L-shape in cross section, so that the cutting wire does not touch the base plate.

In FIG. 3 a foam material plate P is held between the base plate 1 and the press-on cutting rule 3, ready to be cut to a measured size by the heated cutting wire.

In cutting with the heated cutting wire the following procedure is followed:

(a) Push the plate P to be cut as far under the press-on cutting rule 3 as is to be cut off.

(b) Press the press-on cutting rule 3 onto the plate P to hold it in the desired position.

(c) Press the bow of the cutting member B with the cutting wire 6 with its arms onto the lay-on strips 5, so that current flows through the wire 6 and heats it.

(d) With constant pressing on the strips 5, guide the bow downward and cut.

The stops 12 under the base plate 1 can serve as stops on already installed plates.

If the plate P to be cut consists of glass wool, it must be cut with a knife. So that the cut will run perpendicular to the plate surface, the knife must be correctly guided. It is guided there along the press-on cutting rule 3. So that the cut will run perpendicularly to the plate surface, there is provided in a projection 14 of the base plate 1 a guide groove 15 for the guidance of the knife point.

To the base plate 1 there can also be fastened a stop strip 4, which serves for the plate guidance.

What is claimed is:

1. Transportation device for the cutting of plates of soft material with the aid of a cutting member and a base plate, the base plate having lateral guides in which a press-on cutting rule is movable up and down and guided parallel to an end of the base plate, characterized in that the lateral guides (2) are provided with electrically conducting outer lay-on strips (5), which are electrically insulated and connected to a current source, and the cutting member consisting of an electrically heatable wire (6) which is held in a frame-saw type bow (7,8), said cutting member being completely separable from said base plate and said lateral side (2), so that said heatable wire can only be heated when said cutting member is pressed by hand upon said outer lay-on strips, and said cutting member further being completely separable from said lay-on strips (5).

2. Device according to claim 1, characterized in that the bow includes an electrically insulating lengthwise bar (7) to the ends of which there are fastened electrically conducting arms (8) directed downward, between the lower ends of which the electrically heatable cutting wire (6) is tensely held.

3. Device according to claim 2, characterized in that the electrically conducting lay-on strips (5) and the electrically conducting arms (8) of the bow are arranged and dimensioned in such a way that in operation the cutting wire (6) lies over the edge of the base plate (1).

4. Device according to claim characterized in that the press-on cutting rule and the lateral guides are dimensioned and arranged so that the front edge of the cutting rule (3) lies over the edge of the base plate (1) and permits a cutting of a plate (P) by means of a knife guided along the press-on cutting rule (3).

5. Device according to claim 1, characterized in that a front edge of the base plate and a front edge of the press-on cutting rule are provided with an electrically insulating overlay (13, 31).

6. Device according to claim 1, characterized in that the current feed lines (51) lead through the base plate to the electrically conducting lay-on strips.

7. Device according to claim 1, characterized in that on the under-side of the base plate there are mounted stops (12) which are aligned upon the cutting plane.

8. Device according to claim 2, characterized in that the insulating lengthwise bar (7) includes end parts (71) extending on both sides beyond the downward-directed arms, which end parts form a stop.

9. Device according to claim 1, characterized in that to the base plate there is fastenable a stop strip (4).

10. Device according to claim 1, characterized in that the base plate includes a projection (14), the projection (14) having a guide groove (15) for the guidance of the point of a cutting knife.

* * * * *